US009175689B2

(12) United States Patent
Kuwahara et al.

(10) Patent No.: US 9,175,689 B2
(45) Date of Patent: Nov. 3, 2015

(54) PORTABLE BLOWER

(75) Inventors: Yasuaki Kuwahara, Osaka (JP); Tomohisa Itoh, Osaka (JP); Hiroaki Kubo, Osaka (JP); Kensuke Uchimura, Osaka (JP); Akemi Gotoh, Osaka (JP); Ryuhji Asakura, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 481 days.

(21) Appl. No.: 13/641,749

(22) PCT Filed: Jul. 20, 2010

(86) PCT No.: PCT/JP2010/062183

§ 371 (c)(1), (2), (4) Date: Oct. 17, 2012

(87) PCT Pub. No.: WO2011/132330

PCT Pub. Date: Oct. 27, 2011

(65) Prior Publication Data

US 2013/0034426 A1 Feb. 7, 2013

(30) Foreign Application Priority Data

Apr. 19, 2010 (JP) ..... 2010-095765

(51) Int. Cl.

*F04D 25/00* (2006.01)
*F04D 29/00* (2006.01)
*F04D 25/08* (2006.01)

(52) U.S. Cl.

CPC ..... *F04D 25/084* (2013.01)

(58) Field of Classification Search

CPC ..... F04D 25/084
USPC ..... 415/126
See application file for complete search history.

(56) References Cited

U.S. PATENT DOCUMENTS 2,811,305 A * 10/1957 Scaroulis ..... 416/143
3,953,710 A 4/1976 Dyer
6,398,835 B1 * 6/2002 Rehil ..... 55/471
8,608,437 B1 * 12/2013 Cantin, Jr. ..... 415/206

(Continued)

FOREIGN PATENT DOCUMENTS

DE 897911 C * 11/1953
DE 2204807 A1 * 8/1973
JP 34-18441 A 11/1959

(Continued)

OTHER PUBLICATIONS

Kiyomi, Blower, Nov. 25, 1978, JPS 53-135006A abstract.*

(Continued)

*Primary Examiner* — Igor Kershteyn
(74) *Attorney, Agent, or Firm* — Keating & Bennett, LLP

(57) ABSTRACT

A portable blower includes a casing (2) having an intake port (6) and a discharge port (7); an air passage (8) provided inside the casing (2) and connecting between the intake port (6) and the discharge port (7); a blower fan (17) arranged inside the air passage (8); a filter (16) arranged at the intake port (6); and a lid portion (3) openably fitted to the casing (2), the lid portion (3), when open, exposing the intake port (6) and, when closed, covering the intake port (6). When open, the lid portion (3) supports the casing (2) to let it stand on a table top. As the blower fan (17) is operated, outside air is introduced through the intake port (6) into the air passage (8) so as to be sent out through the discharge port (7).

13 Claims, 5 Drawing Sheets

(56) References Cited

U.S. PATENT DOCUMENTS

| | | | | |
|---|---|---|---|---|
| 2006/0181845 | A1* | 8/2006 | Shah et al. | 361/685 |
| 2007/0209701 | A1* | 9/2007 | Lasko et al. | 137/15.01 |

FOREIGN PATENT DOCUMENTS

| | | | | |
|---|---|---|---|---|
| JP | 50-42952 | A | | 4/1975 |
| JP | 52-137147 | U | | 10/1977 |
| JP | S53-135006 | A | * | 11/1978 |
| JP | 3051910 | U | | 9/1998 |
| JP | 11-159499 | A | | 6/1999 |
| JP | 2003-314488 | A | | 11/2003 |
| JP | 2008-057519 | A | | 3/2008 |

OTHER PUBLICATIONS

Official Communication issued in International Patent Application No. PCT/JP2010/062183, mailed on Oct. 19, 2010.

* cited by examiner

PORTABLE BLOWER

TECHNICAL FIELD

The present invention relates to portable blowers provided with a blower fan in a portable casing.

BACKGROUND ART

A conventional portable blower is disclosed in Patent Document 1 listed below. This portable blower has a portable casing in the shape of a thin box, with an intake port open in the rear face and a discharge port open in the front face. Inside the casing, an air passage is provided which connects between the intake port and the discharge port, and inside the air passage, a blower fan is arranged which is an axial fan. Moreover, on the side faces of the casing, a swingable stand is provided. When the stand is swung out into contact with a table top, it supports the casing to let it stand on the table top.

The portable blower is carried around, typically, in a state where the casing is held in a hand, in a state where the casing is suspended from the user's neck, or in a state where the casing is put in a pocket of the user's clothes. It is in a state where the casing is held in a hand or in a state where the casing is standing on a table top with the help of the stand that the blower fan is operated. As the blower fan is operated, outside air is introduced through the intake port into the air passage, and a stream of air is sent out through the discharge port toward the user's head etc. This allows the user to readily enjoy the cool outdoors and indoors.

LIST OF CITATIONS

Patent Literature

Patent Document 1: JP-A-2008-57519 (pages 1-3; FIG. 1)

SUMMARY OF INVENTION

Technical Problem

In blowing devices in general, with a view to preventing entry of dust into the casing, a filter for collecting dust is provided at the intake port. Inconveniently, with the conventional portable blower mentioned above, while it is carried around, the dust attached to the filter may fall out and fly into the surrounding or attach to clothes. This has been diminishing the usability of the portable blower.

An object of the present invention is to provide a portable blower with improved usability.

Solution to Problem

To achieve the above object, according to the present invention, a portable blower includes: a casing having an intake port and a discharge port open therein; an air passage provided inside the casing and connecting between the intake port and the discharge port; a blower fan arranged inside the air passage; a filter arranged at the intake port; and a lid portion openably fitted to the casing, the lid portion, when open, exposing the intake port and, when closed, covering the intake port. When open, the lid portion supports the casing to let it stand on a table top. As the blower fan is operated, outside air is introduced through the intake port into the air passage so as to be sent out through the discharge port.

With this configuration, when the lid portion is opened and put on a table top, the lid portion supports the casing to let it stand on the table top. As the blower fan is operated, outside air is introduced through the intake port into the air passage. Meanwhile, dust contained in the outside air is collected by the filter. The air that passes through the air passage is sent out through the discharge port toward the user's head etc. The portable blower is carried around in a state where the lid portion is closed and hence the intake port is stopped.

In the portable blower configured as described above, preferably, when the lid portion is closed, a gap is left between the lid portion and the casing so that, as the blower fan is operated, outside air is introduced through the gap to the intake port.

With this configuration, in a state where the lid portion is closed and in addition the casing is held in a hand or the casing is suspended from the user's neck, the blower fan is operated. Thus, outside air is introduced through the gap between the lid portion and the casing to the intake port, and the air that passes through the air passage is sent out through the discharge port toward the user's head etc.

In the portable blower configured as described above, preferably, when the lid portion is closed, it covers the periphery of the intake port, and the depth of the gap opposite the intake port is greater than the depth of the gap opposite the periphery of the intake port.

In the portable blower configured as described above, preferably, there is further provided an open/close detection portion for detecting whether the lid portion is open or closed. When the open/close detection portion detects the lid portion to be opened, the blower fan is operated and, when the open/close detection portion detects the lid portion to be closed, the blower fan stops being operated. With this configuration, when the lid portion is opened, the open/close detection portion detects it and the blower fan is operated, with a result that a stream of air is sent out through the discharge port. When the lid portion is closed, the blower fan stops being operated.

In the portable blower configured as described above, preferably, the casing is formed in a shape of a thin box. The intake port is provided in the face of the casing perpendicular to the thickness direction of the casing. The discharge port is provided in a circumferential face contiguous with the face in which the intake port is formed. The lid portion is pivoted at an end part of the casing away from the discharge port. With this configuration, when the swingable lid portion is opened and put on a table top, the casing in the shape of a thin box remains standing with the discharge port in the top face; thus, outside air is sucked in through the intake port provided in the front face of the casing, and a stream of air is sent out upward through the discharge port in the top face.

In the portable blower configured as described above, preferably, an ion generator for releasing ions is provided inside the air passage. With this configuration, as the blower fan is operated, air containing ions is sent out through the discharge port. This allows the user to sterilize or otherwise treat his surroundings.

Advantageous Effects of the Invention

According to the present invention, with the openable lid is closed, the intake port fitted with the filter is covered. This prevents, the dust attached to the filter from falling off while the portable blower is carried around, Moreover, with the lid portion open, it supports the casing to let it stand on a table top, and thereby helps set up the portable blower there. This eliminates the need to provide a separate stand for letting the casing stand. This helps hold the cost down, and helps improve the usability of the portable blower.

DESCRIPTION OF EMBODIMENTS

Figure 1:
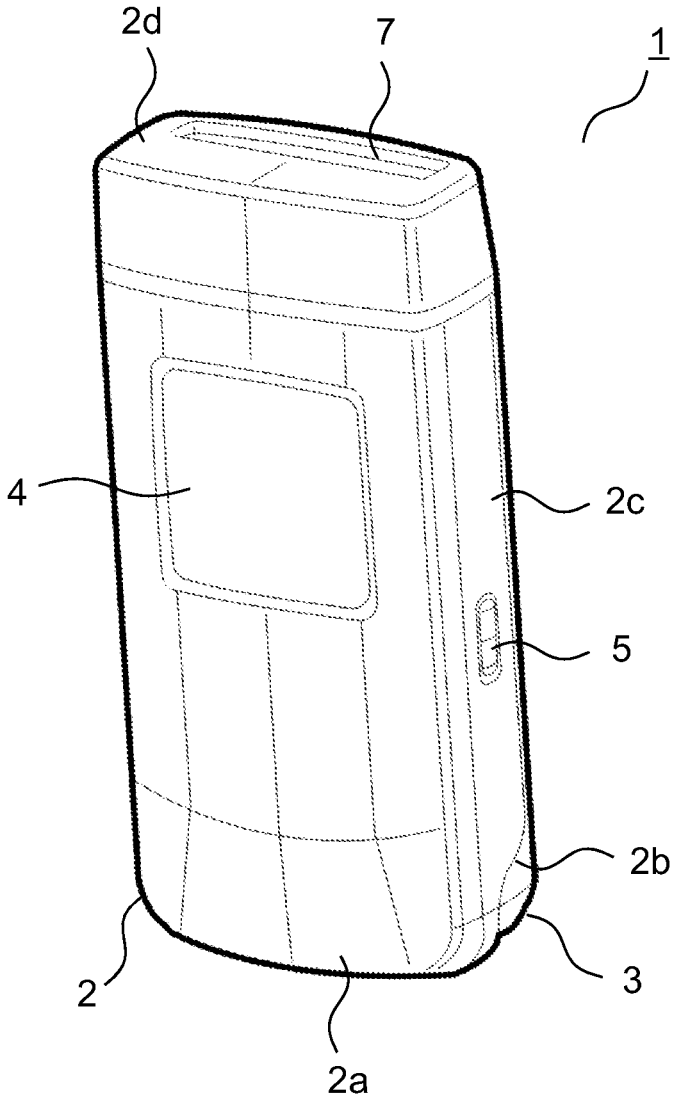
[FIG. 1] is a perspective view of a portable blower embodying invention, as seen from in front.

Hereinafter, embodiments of the present invention will be described with reference to the accompanying drawings. FIG. 1 is a perspective view of a portable blower embodying the invention. The portable blower 1 has a portably sized casing 2 in the shape of a slim box that is rectangular as seen in a front view. On the front face 2*a* of the casing 2 which is perpendicular to its thickness direction, a display portion 4 is provided. The display portion 4 has a liquid crystal display panel or the like, and displays the operating state etc. of the portable blower 1.

The rear face 2*b* opposite from the front face 2*a* is perpendicular to the thickness direction of the casing 2, and is covered by a swingable lid portion 3. On one side face 2*c*, which is one of the circumferential faces of the casing 2 that are contiguous with the front and rear faces 2*a* and 2*b*, a power switch 5 is provided. In the top face 2*d*, which is another of the circumferential faces of the casing 2, a discharge port 7 is open. The discharge port 7 is fitted with a lattice-shaped grill 7*a*.

Figure 2:
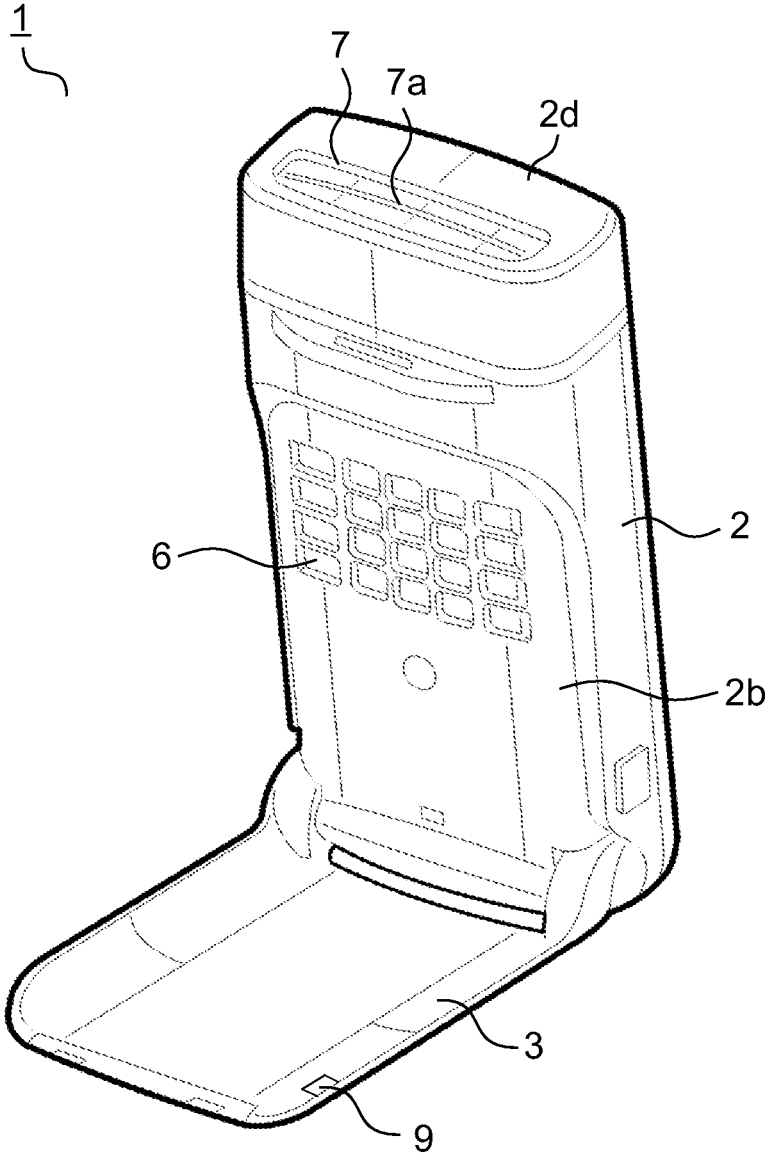
[FIG. 2] is a perspective view of the portable blower embodying invention, as seen from behind

FIG. 2 is a perspective view of the portable blower 1 as seen from behind, in a state where the lid portion 3 is open. The lid portion 3 is pivoted on the casing 2 at a bottom end part thereof away from the discharge port 7, and in the rear face 2*b* of the casing 2, an intake port 6 is open which is composed of a plurality of perforations. When the lid portion 3 is open, the intake port 6 is exposed; when the lid portion 3 is closed, the intake port 6 along with a periphery thereof is concealed. When opened, the lid portion 3 supports the casing 2 to let it stand on a table top, and thereby helps set up the portable blower 1 there.

On the inner surface of the lid portion 3, a magnet 9 is provided. Inside the casing 2, in a position facing the magnet 9 when the lid portion 3 is closed, a magnetism detector (such as a Hall device or a reed switch) is provided. Detecting the magnetism of the magnet 9 with the magnetism detector enables the detection of whether the lid portion 3 is open or closed. Thus, the magnet 9 and the magnetism detector together constitute an open/close detection portion which detects whether the lid portion 3 is open or closed. The open/close detection portion may instead be configured with a push button switch or the like.

Figure 3:
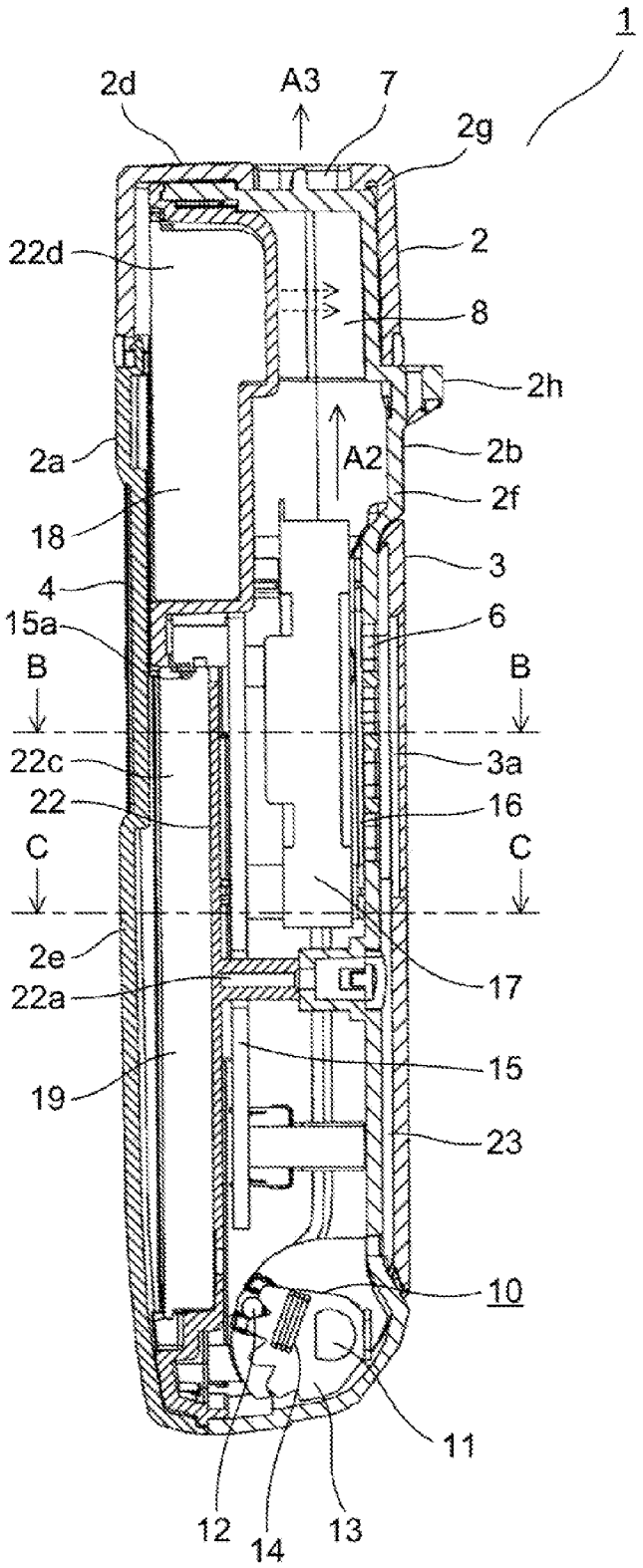
[FIG. 3] is a right side sectional view of the portable blower embodying invention.
Figure 4:
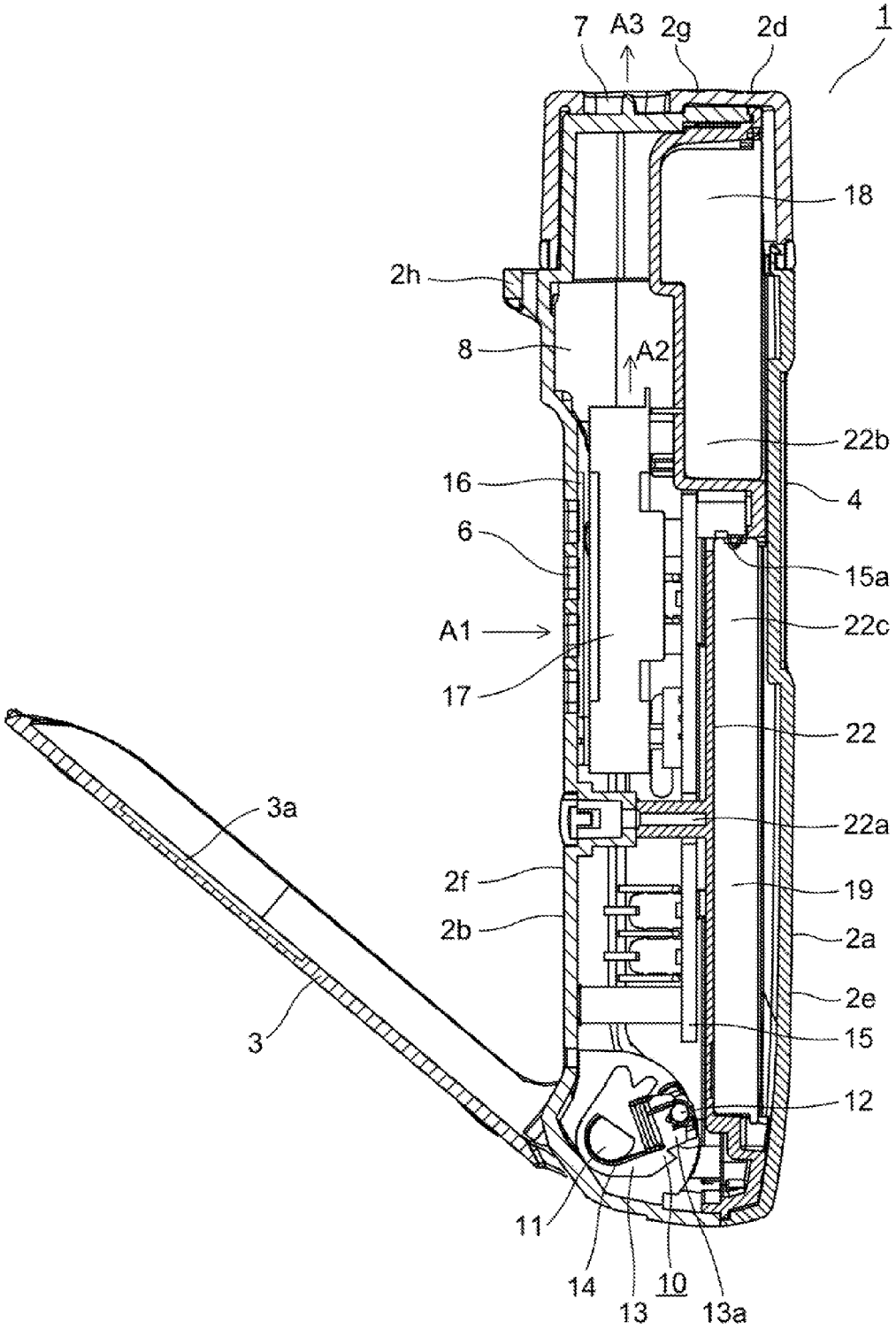
[FIG. 4] is a left side sectional view of the portable blower embodying invention.
Figure 5:
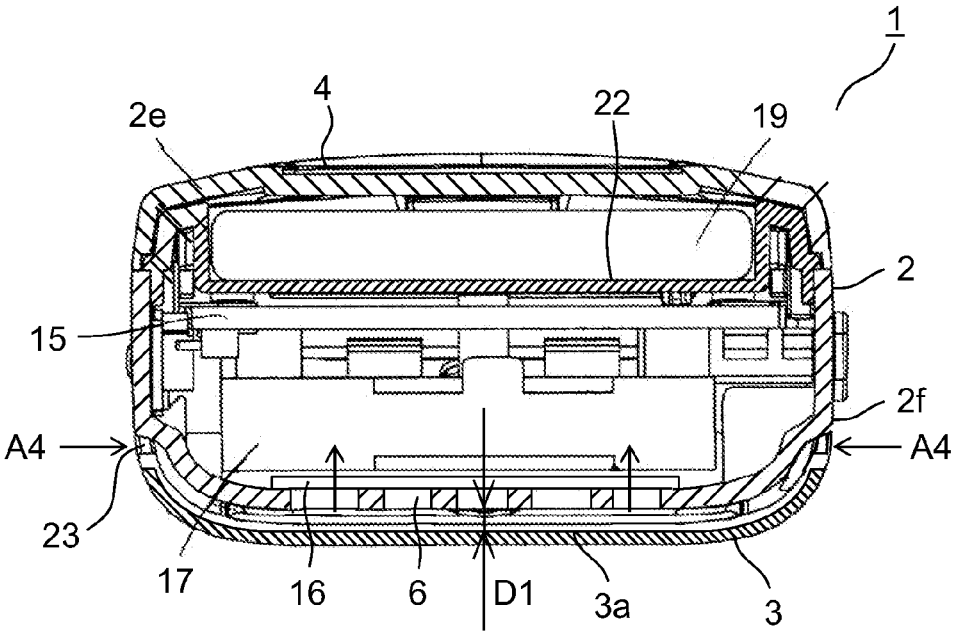
[FIG. 5] is a sectional view along line B-B in FIG. 3.
Figure 6:
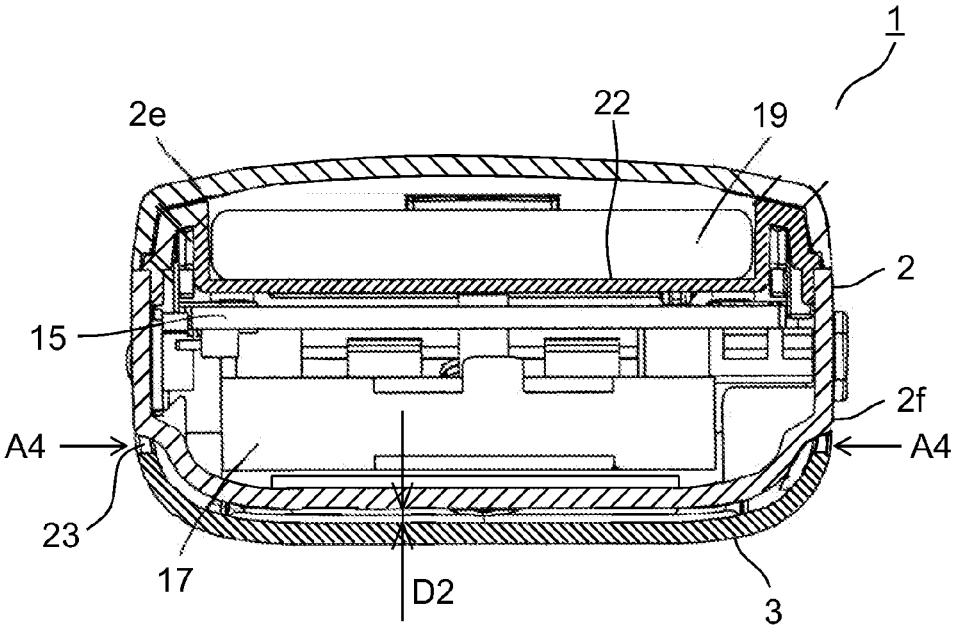
[FIG. 6] is a sectional view along line C-C in FIG. 3.

FIG. 3 is a right side sectional view of the portable blower 1, in a state where the lid portion 3 is closed, and FIG. 4 is a left side sectional view of the same, in a state where the lid portion 3 is open. FIGS. 5 and 6 are sectional views along lines B-B and C-C, respectively, in FIG. 3. The casing 2 has a rear panel 2*f* which forms the rear face 2*b*. The rear panel 2*f* has a square bracket-shaped cross section as seen from above, and is open at the front.

The open part of the rear panel 2*f* at the front thereof is covered by a partition panel 22. The partition panel 22 is fitted to the rear panel 2*f* with screws (not shown) that thread into screw holes 22*a*. On the front of the partition panel 22, a front panel 2*e* is attached, which forms the front face 2*a* of the casing 2 and has a square bracket-shaped cross section as seen from above.

On top parts of the front panel 2*e* and the rear panel 2*f*, a cap-shaped top cover 2*g* is fitted. The side faces of the casing 2 are formed by the front panel 2*e* and the rear panel 2*f*, which each have a square bracket-shaped cross section. In a top part of the rear panel 2*f*, a hole 2*h* is provided to pass a neck strap through. This allows the portable blower 1 to be carried around suspended from the user's neck.

The lid portion 3 is pivoted on the casing 2 via a hinge mechanism 10. The hinge mechanism 10 includes a first shaft 11, a second shaft 12, a gear 13, and a tension spring 14. The first shaft 11 is provided integrally with the lid portion 3, and is rotatably supported on the rear panel 2*f*. The first shaft 11 forms the rotary shaft of the lid portion 3.

The second shaft 12 is supported on the rear panel 2*f*, and is arranged to be movable in the radial direction of the first shaft 11. The gear 13 is provided integrally with the first shaft 11, and a plurality of cogs 13*a* are formed on a segment of the gear 13 over a central angle less than 90 degrees. The second shaft 12 is arranged between adjacent cogs 13*a* of the gear 13. The tension spring 14 is, at both ends thereof, hooked on the first and second shafts 11 and 12 respectively, and constitutes a biasing means for biasing the second shaft 12 in a direction in which it is pressed against the gear 13.

As the lid portion 3 swings, the first shaft 11 and the gear 13 rotate together, and the second shaft 12 moves toward the cog ridge of the gear 13 against the biasing force of the tension spring 14. Thus, in relative terms, the second shaft 12 moves in the circumferential direction, from one cog 13*a* to the next. This allows the lid portion 3 to be positioned at desired angles of 90 degrees or less with respect to the casing 2.

When the lid portion 3 is closed, it leaves a gap 23 from the rear panel 2*f*. The gap 23 extends between both side end faces of the lid portion 3, so that, even in a state where the lid portion 3 is closed, outside air can pass through the gap 23 into the intake port 6. On the inner surface of the lid portion 3, in a position opposite the intake port 6, a recessed portion 3*a* is provided. Owing to the recessed portion 3*a*, the depth D1 of the gap 23 opposite the intake port 6 is greater than the depth D2 of the gap 23 opposite the periphery of the intake port 6. There may be left no gap 23 opposite the periphery of the intake port 6 such that D2=0.

The recessed portion 3*a* makes the lid portion 3 thinner there, but helps prevent the portable blower 1 from becoming unduly large; besides, the lid portion 3 can be given sufficient rigidity with the thickness of its part opposite the periphery of the intake port 6. The lid portion 3 may be made to protrude rearward at the recessed portion 3*a* to be thicker there so that the lid portion 3 has improved rigidity. In that case, the protruding part of the lid portion 3 is only a part thereof opposite the intake port 6, and this helps prevent the portable blower 1 from becoming unduly large.

Inside the rear panel 2*f*, as a result of its front being covered with the partition panel 22, an air passage 8 is formed which connects between the intake port 6 and the discharge port 7. Inside the air passage 8, a blower fan 17 is arranged which is a centrifugal fan. The suction port (not shown) of the blower fan 17 is arranged opposite the intake port 6, and the exhaust port (not shown) of the blower fan 17 is arranged in a direction pointing to the discharge port 7. The blower fan 17 is arranged at a predetermined distance, in the axial direction, from the rear panel 2*f*, and at the intake port 6, a filter 16 is arranged which is fixed on the inner side of the rear panel 2*f* and which collects dust.

The partition panel 22 forms, in a front top part of the casing 2, an isolated compartment 22*b* and, in a front bottom part of the casing 2, an isolated compartment 22*c*. On the rear side of the partition panel 22, a control circuit board 15 is fitted on which is mounted a control circuit for the portable blower 1. To the control circuit board 15, terminal portions 15*a* are connected which face onto the isolated compartments 22*b* and 22*c* respectively. In the isolated compartments 22*b* and 22*c*, an ion generator 18 and a battery 19 are respectively accommodated, which are connected via the terminal portions 15*a* to the control circuit.

The ion generator 18 has a plurality of electrodes (not shown) facing onto the air passage 8. To the electrodes, a voltage with an alternating-current waveform or an impulse waveform is applied. To one electrode is applied a positive voltage so that the ions resulting from ionization combine with moisture in the air to produce cluster ions with positive charge composed mainly of $H^+(H_2O)m$. To the other electrode is applied a negative voltage so that the ions resulting from ionization combine with moisture in the air to produce cluster ions with negative charge composed mainly of $O_2^-(H_2O)n$. Here, m and n are each an arbitrary natural number.

The ions $H^+(H_2O)m$ and $O_2^-(H_2O)n$ coagulate on the surface of airborne microbes in the air and of odor components and surround them. As given by formula (1) to (3) below, through collision, they coagulate on the surface of airborne microbes and of odor components to generate [.OH] (hydroxyl radical) and $H_2O_2$ (hydrogen peroxide) and thereby destroy them. Here, m' and n' are each an arbitrary natural number.

$$H^+(H_2O)m+O_2^-(H_2O)n \rightarrow .OH+\tfrac{1}{2}O_2+(m+n)H_2O \quad (1)$$

$$H^+(H_2O)m+H^+(H_2O)m'+O_2^-(H_2O)n+O_2^-(H_2O)n' \rightarrow 2.OH+O_2+(m+m'+n+n')H_2O \quad (2)$$

$$H^+(H_2O)m+H^+(H_2O)m'+O_2^-(H_2O)n+O_2^-(H_2O)n' \rightarrow H_2O_2+O_2+(m+m'+n+n')H_2O \quad (3)$$

Configured as described above, the portable blower 1 is carried around in a state where the lid portion 3 is closed. When the lid portion 3 is opened at a desired angle and put on a table top, the lid portion 3 supports the casing 2 to let it stand on the table top. When the power switch 5 is turned on, the blower fan 17 and the ion generator 18 are operated. As the blower fan 17 operates, outside air is introduced through the intake port 6 into the air passage 8 as indicated by arrow A1 (see FIG. 4). Meanwhile, dust contained in the outside air is collected by the filter 16.

The air that passes through the air passage 8 as indicated by arrow A2 (see FIGS. 3 and 4) contains the ions generated by the ion generator 18. A stream of air containing positive and negative ions is then sent out through the discharge port 7 toward the user's head etc. as indicated by arrow A3 (see FIGS. 3 and 4). This allows the user to readily enjoy the cool outdoors and indoors, and simultaneously to sterilize and remove odors in the user's surroundings.

While the portable blower 1 is carried around, when the lid portion 3 is closed, the intake port 6 is covered by the lid portion 3. This prevents the dust attached to the filter 16 from falling out, and thus prevents it from flying into the surroundings and attaching to clothes etc.

While the portable blower 1 is carried around in a state suspended from the user's neck or in a state held in a hand, when the power switch 5 is turned on, outside air is introduced through the gap 23 to the intake port 6 as indicated by arrows A4 (see FIGS. 5 and 6). Here, owing to the recessed portion 3*a* of the lid portion 3, the air passage has a larger cross sectional area opposite the intake port 6 than opposite the periphery of the intake port 6. This helps reduce the lessening in the amount of passing air.

A stream of air containing ions is then sent out upward through the discharge port 7 arranged in the top face 2*d*. Thus, even while the portable blower 1 is carried around, the user can enjoy the cool, and can also sterilize and remove odors in the user's surroundings.

The power switch 5 has a "sleep" position for bringing the portable blower 1 into a sleep state. When the power switch 5 is at the sleep position, the blower fan 17 and the ion generator 18 operate in response to the opening and closing of the lid portion 3. Specifically, when the open/close detection portion detects the lid portion 3 to be opened, the blower fan 17 and the ion generator 18 are operated; when the open/close detection portion detects the lid portion 3 to be closed, the blower fan 17 and the ion generator 18 stop being operated. Thus, when the user opens the lid portion 3 and sets up the portable blower 1 on a table top, a stream of air containing ions is sent out through the discharge port 7, and this saves the user from operating the power switch 5.

In this embodiment, when the openable lid portion 3 is closed, the intake port 6 fitted with the filter 16 is closed. Thus, when the portable blower 1 is carried around, the dust attached to the filter 16 is prevented from falling out. Moreover, when the lid portion 3 is open, it supports the casing 2 to let it stand on a table top, and thereby helps set up the portable blower 1 there. This eliminates the need to provide a separate stand for letting the casing 2 stand. This helps hold the cost down, and helps improve the usability of the portable blower 1.

Moreover, when the lid portion 3 is closed, the gap 23 is left between the lid portion 3 and the casing 2 so that, as the blower fan 17 is operated, outside air is introduced through the gap 23 to the intake port 6. Thus, even when the portable blower 1 is carried around, the user can enjoy the cool.

Moreover, when the lid portion 3 is closed, it covers the periphery of the intake port 6 such that the depth D1 of the gap 23 opposite the intake port 6 is greater than the depth D2 of the gap 23 opposite the periphery of the intake port 6. This helps prevent the portable blower 1 from becoming unduly large, and helps reduce the lessening in the amount of passing air.

Moreover, in the sleep state, when the open/close detection portion finds the lid portion 3 to be opened, the blower fan 17 is operated and, when the open/close detection portion finds the lid portion 3 to be closed, the blower fan 17 stops being operated. This saves the user from operating the power switch 5, and helps improve the usability of the portable blower 1.

Moreover, the casing 2 is formed in the shape of a slim box, with the intake port 6 provided in the rear face 2*b* perpendicular to the thickness direction of the casing 2, with the discharge port 7 provided in the top face contiguous with the rear face 2*b*, and the lid portion 3 is pivoted at a bottom end part of the casing 2 away from the discharge port 7. Thus, when the portable blower 1 is set up on a table top, it is possible to readily send out a stream of air upward where the user's head is located.

Moreover, inside the air passage 8, the ion generator 18 is provided. Thus, it is possible to sterilize and remove odors in the user's surroundings.

In this embodiment, the ion generator 18 may release negative ions alone. This helps the user enjoy their relaxing effect.

Industrial Applicability

The present invention finds applications in portable blowers provided with a blower fan in a portable casing.

LIST OF REFERENCE SIGNS

1 portable blower
2 casing
2*e* front panel
2*f* rear panel
2*g* top cover
3 lid portion
4 display portion
5 power switch
6 intake port
7 discharge port
8 air passage
9 magnet
10 hinge mechanism
11 first shaft
12 second shaft
13 gear
14 tension spring
15 control circuit board
16 filter
17 blower fan
18 ion generator
19 battery
22 partition panel
23 gap

The invention claimed is:

1. A portable blower comprising:
a casing having an intake port and a discharge port open therein;
an air passage provided inside the casing and connecting between the intake port and the discharge port;
a blower fan arranged inside the air passage;
a filter arranged at the intake port; and
a lid portion openably fitted to the casing, the lid portion, when open, exposing the intake port and, when closed, covering the intake port, wherein
when the lid portion is open, the lid portion supports the casing to let the casing stand on a table top,
as the blower fan is operated, outside air is introduced through the intake port into the air passage so as to be sent out through the discharge port, and
when the lid portion is closed, a gap is left between the lid portion and the casing so that, as the blower fan is operated, outside air is introduced through the gap tp the intake port.

2. The portable blower according to claim 1, wherein
when the lid portion is closed, the lid portion covers a periphery of the intake port, and a depth of the gap opposite the intake port is greater than a depth of the gap opposite the periphery of the intake port.

3. The portable blower according to claim 1, further comprising an open/close detection portion for detecting whether the lid portion is open or closed, wherein
when the open/close detection portion detects the lid portion to be opened, the blower fan is operated and, when the open/close detection portion detects the lid portion to be closed, the blower fan stops being operated.

4. A portable blower comprising:
a casing having an intake port and a discharge port open therein;
an air passage provided inside the casing and connecting between the intake port and the discharge port;
a blower fan arranged inside the air passage;
a filter arranged at the intake port; and
a lid portion openably fitted to the casing, the lid portion, when open, exposing the intake port and, when closed, covering the intake port, wherein
when the lid portion is open, the lid portion supports the casing to let the casing stand on a table top,
as the blower fan is operated, outside air is introduced through the intake port into the air passage so as to be sent out through the discharge port,
the casing is formed in a shape of a thin box,
a recessed portion is defined in a face of the casing perpendicular or substantially perpendicular to a thickness direction of the casing,
the intake port is provided in a bottom face of the recessed portion,
the discharge port is provided in a circumferential face contiguous with the face in which the intake port is formed, and
the lid portion is pivoted at an end portion of the casing away from the discharge port such that, when the lid portion is closed, the lid portion fits into the recessed portion.

5. The portable blower according to claim 1, wherein
an ion generator for releasing ions is provided inside the air passage.

6. The portable blower according to claim 2, wherein
the casing is formed in a shape of a thin box,
the intake port is provided in a face of the casing perpendicular to a thickness direction of the casing,
the discharge port is provided in a circumferential face contiguous with the face in which the intake port is formed, and
the lid portion is pivoted at an end part of the casing away from the discharge port.

7. The portable blower according to claim 3, wherein
the casing is formed in a shape of a thin box,
the intake port is provided in a face of the casing perpendicular to a thickness direction of the casing,
the discharge port is provided in a circumferential face contiguous with the face in which the intake port is formed, and
the lid portion is pivoted at an end part of the casing away from the discharge port.

8. The portable blower according to claim 2, wherein
an ion generator for releasing ions is provided inside the air passage.

9. The portable blower according to claim 3, wherein
an ion generator for releasing ions is provided inside the air passage.

10. The portable blower according to claim 1, wherein
the casing is formed in a shape of a thin box,
the intake port is provided in a face of the casing perpendicular to a thickness direction of the casing,
the discharge port is provided in a circumferential face contiguous with the face in which the intake port is formed, and
the lid portion is pivoted at an end part of the casing away from the discharge port.

11. The portable blower according to claim 4, further comprising an open/close detection portion for detecting whether the lid portion is open or closed, wherein
when the open/close detection portion detects the lid portion to be opened, the blower fan is operated and, when the open/close detection portion detects the lid portion to be closed, the blower fan stops being operated.

12. The portable blower according to claim 4, wherein
an ion generator for releasing ions is provided inside the air passage.

13. The portable blower according to claim 11, wherein an ion generator for releasing ions is provided inside the air passage.

* * * * *